United States Patent [19]

Kunkle et al.

[11] 4,080,037

[45] Mar. 21, 1978

[54] RECEPTACLE TERMINAL FOR PRINTED CIRCUIT BOARD

[75] Inventors: John Philip Kunkle, Harrisburg; Billy Erik Olsson, New Cumberland, both of Pa.

[73] Assignee: AMP Incorporated, Harrisburg, Pa.

[21] Appl. No.: 757,276

[22] Filed: Jan. 6, 1977

[51] Int. Cl.[2] ..... H01R 13/12

[52] U.S. Cl. ..... 339/258 R; 339/275 B

[58] Field of Search ..... 339/17 CF, 256 R, 258, 339/275 B, 275 T

[56] References Cited

U.S. PATENT DOCUMENTS

| | | | |
|---|---|---|---|
| 3,803,537 | 4/1974 | Cobaugh et al. | 339/256 R |
| 4,012,107 | 3/1977 | Cobaugh et al. | 339/258 P |

FOREIGN PATENT DOCUMENTS

| | | | |
|---|---|---|---|
| 1,440,488 | 4/1966 | France | 339/258 R |
| 738,829 | 10/1955 | United Kingdom | 339/258 R |

*Primary Examiner*—Joseph H. McGlynn
*Attorney, Agent, or Firm*—Frederick W. Raring; Jay L. Seitchik

[57] ABSTRACT

Stamped and formed terminal receptacle for a printed circuit board comprises a hollow tubular receptacle portion, a transition portion, and a mounting portion. The tubular receptacle portion has a lead-receiving upper end and contains a hairpin type spring which extends downwardly from one wall of the receptacle and is reversely bent so that it extends upwardly toward the lead-receiving end. The tip of this spring is formed laterally of the axis of the receptacle to provide an inclined lead-in surface for the lead. The transition portion has features which prevent the flow of solder into the receptacle portion during soldering and the mounting portion has improved means for holding the terminal in the hole on the printed circuit board during handling prior to wave soldering.

5 Claims, 11 Drawing Figures

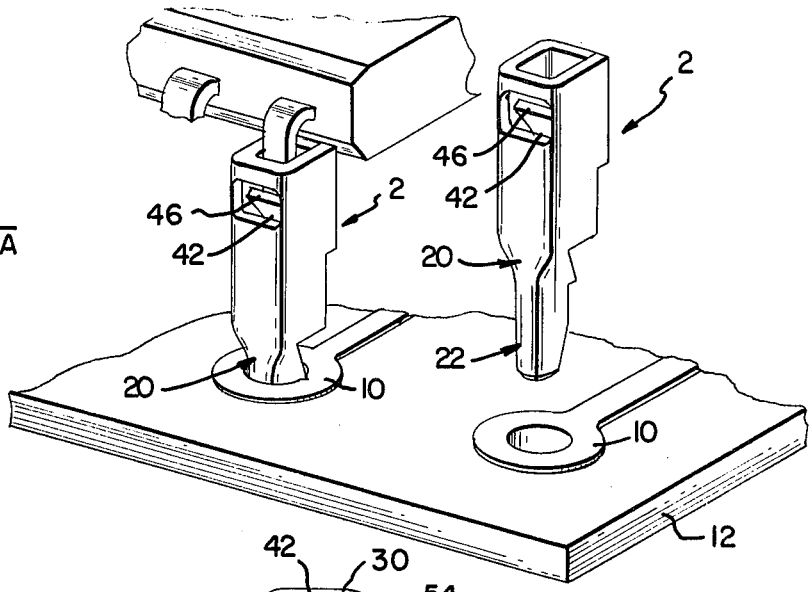
Fig. 1A
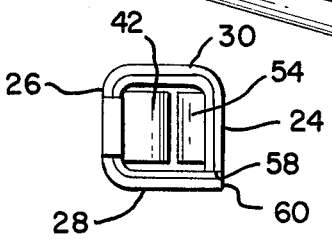
Fig. 3
Fig. 1
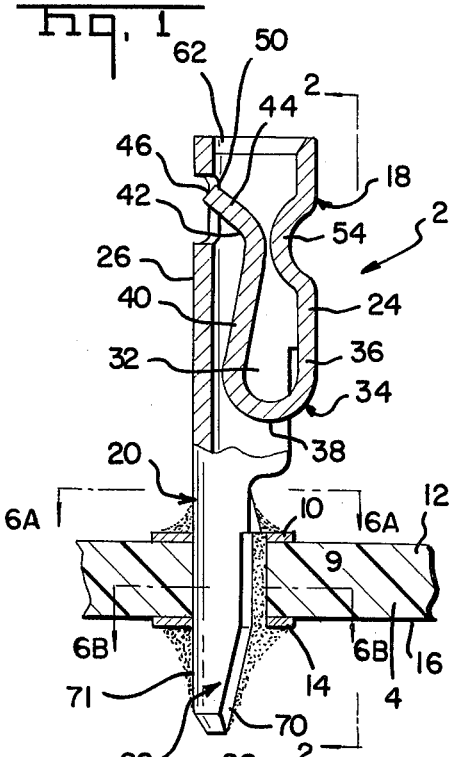
Fig. 2
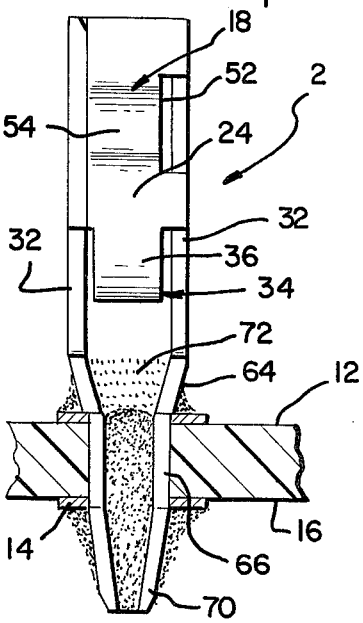
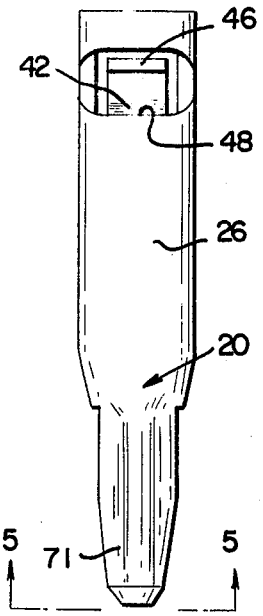
Fig. 4
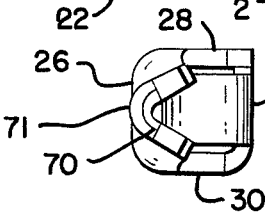
Fig. 5

Fig. 6
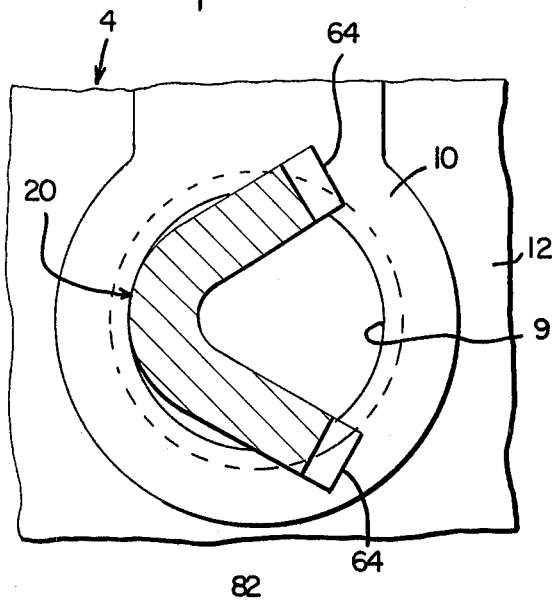
Fig. 6A
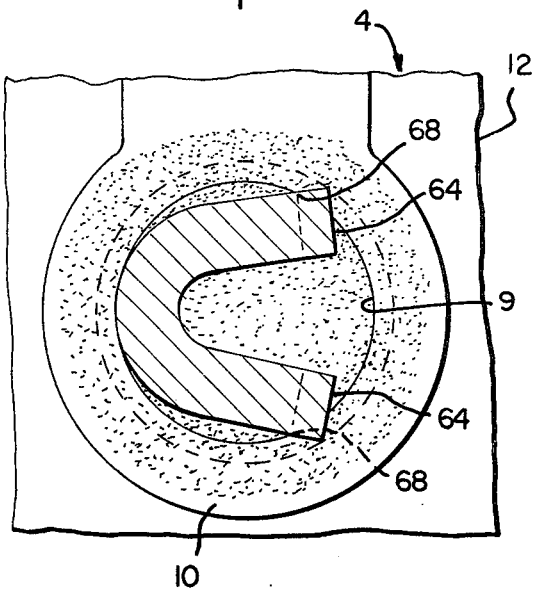
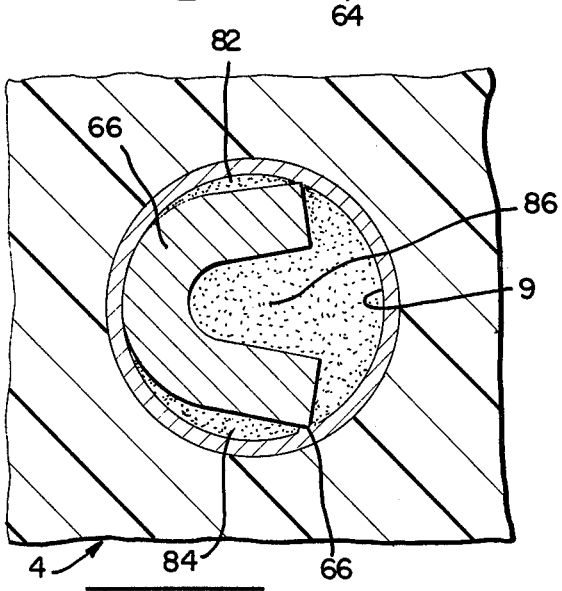
Fig. 6B
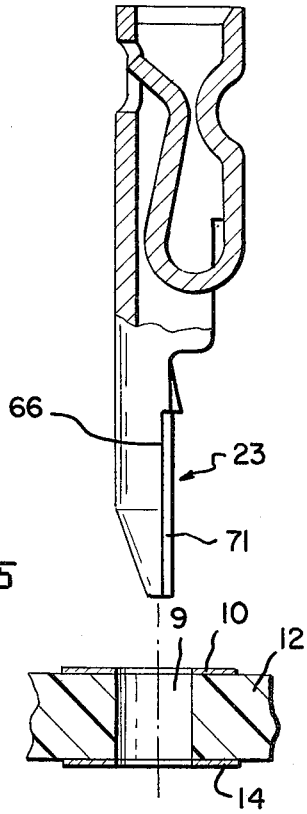
Fig. 8

RECEPTACLE TERMINAL FOR PRINTED CIRCUIT BOARD

BACKGROUND OF THE INVENTION

This invention relates to terminal receptacle devices of the type which are commonly mounted on printed circuit boards and which receive leads from dual inline packages (DIP's) or other types of circuit packages mounted on the board.

It is common practice to produce printed circuit board assemblies by providing holes in the circuit board, mounting terminal receptacle devices in the holes and soldering the ends of the receptacle devices to the conductors on the circuit board. Circuit packages, such as DIP's are then connected to the circuit board conductors by inserting the leads from the DIP's into the receptacles.

A wide variety of these receptacle devices have been developed for use under all of the specific conditions encountered in the manufacture of circuit boards. For example, some circuit boards have holes which are plated, that is, the wall of the hole is provided with a thin plating of metal to connect conductor pads on opposite surfaces of the board and to facilitate soldering. Other circuit boards have unplated holes and require a different type of terminal than those used on boards having plated-through holes. To cite a further example, some receptacle terminals are intended to be mounted in insulating housings such that the leads from the terminals extend from the lower surface of the housing. The housings are assembled to the board by inserting the leads through holes in the board and then soldering, by wave soldering techniques, the leads to the circuit paths on the circuit board. Other terminals are specifically designed to be freestanding on the board, that is, they stand alone, and are not used in conjunction with a separate insulating housing. A further variation relates to the conductors on the printed circuit board; some circuit boards have conductors on only one side or the other (the upper or lower surface) and other circuit boards have conductors on both sides thereof and again, specialized receptacle terminals have been developed for each arrangement of the conductors on the board surface.

Some typical receptacle terminals which are being used or which have been proposed in the past are shown in U.S. Pat. Nos. 3,609,640, 3,673,551, 3,384,865, 3,718,895, 3,188,599, and 3,659,243. A review of the specifications of these patents, particularly those which were issued most recently will reveal some of the highly specialized conditions and problems which are addressed by the receptacle terminals shown therein.

The present invention is specifically directed to the achievement of a receptacle terminal having improved soldering characteristics, having improved spring means which permits it to accept leads of widely varying thicknesses, improved mounting means which provide a stable mounting on the circuit board, and a terminal device which can be produced at a moderate cost and inserted into the circuit board by automatic or semi-automatic insertion machines.

It is accordingly an object of the invention to provide an improved receptacle terminal for use on printed circuit boards. A further object is to provide a terminal device having an improved spring therein which permits the device to be used with leads of varying thicknesses. A further object is to provide a terminal device having improved soldering characteristics and which can be soldered to the board without risk of solder flow into the active portion of the terminals, that is, the portions including the spring which receive an inserted lead.

These and other objects of the invention are achieved in a preferred embodiment thereof which is briefly described in the foregoing abstract, which is described in detail below, and which is shown in the accompanying drawing in which:

FIG. 1 is a sectional side view of a preferred form of terminal devices in accordance with the invention showing the terminal mounted in a hole in a printed circuit board and soldered to conductor paths on both surfaces of the circuit board.

FIG. 1A is a fragmentary perspective view of a printed circuit board having a terminal device mounted in the board.

Figure 7:
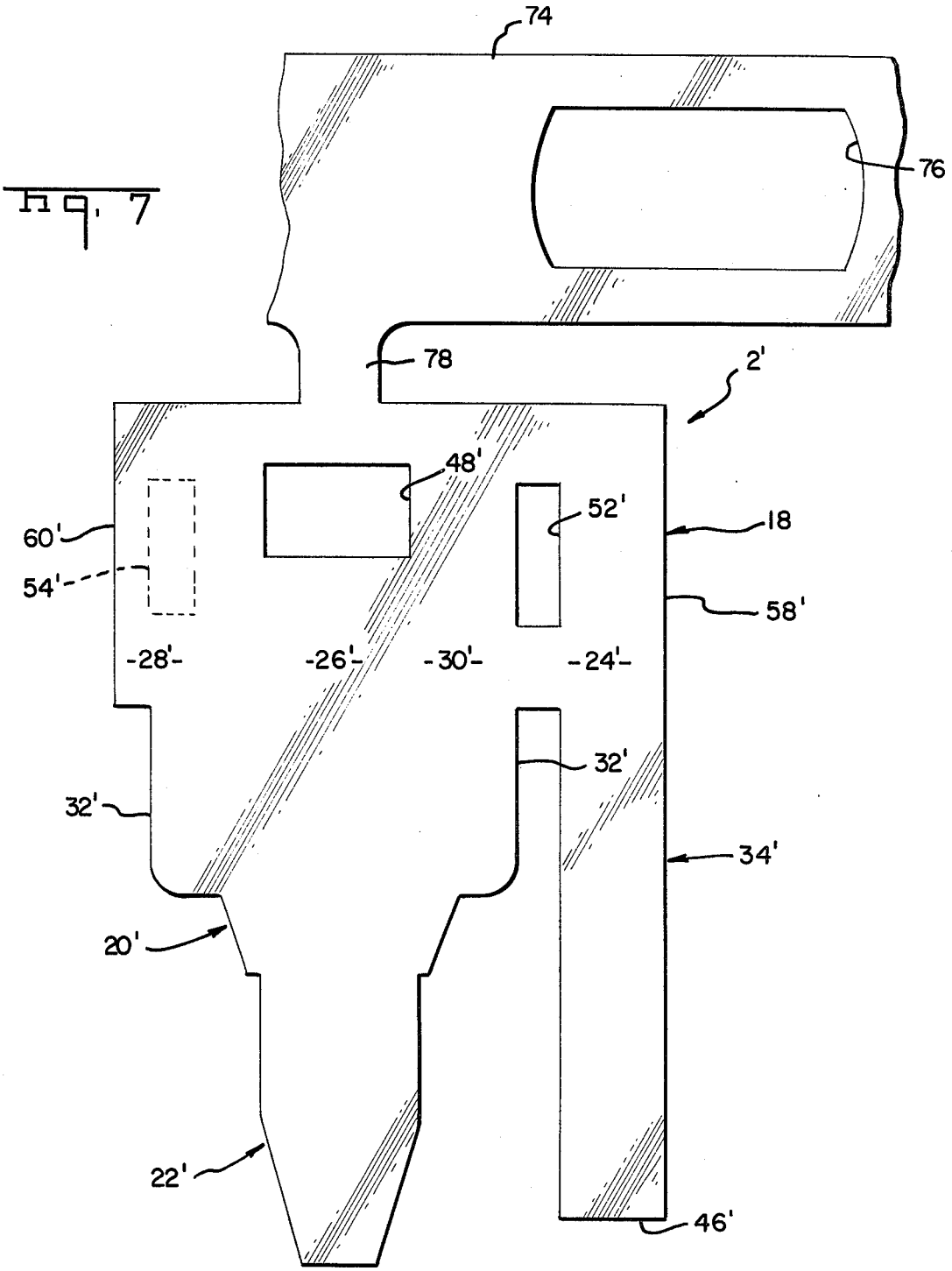

FIGS. 2 and 3 are taken along the lines 2—2 and 3—3 of FIG. 1.

FIG. 4 is a view of the rearward side of the terminal of FIG. 1.

FIG. 5 is a view taken along the lines 5—5 of FIG. 4.

FIG. 6 is a view taken along the lines 6—6 of FIG. 4.

FIGS. 6A and 6B are views taken along the lines 6A-6A and 6B-6B of FIG. 1.

FIG. 7 is a plan view of the metal blank from which the terminal of FIG. 1 is formed by a series of forming and bending operations.

FIG. 8 is a view showing a terminal having a modified lower end which is particularly intended for insertion by automatic insertion machines into a circuit board.

Referring first to FIGS. 1-4, a preferred form of terminal receptacle 2 in accordance with the invention is intended to be inserted through an opening 9 in a printed circuit board 4 and soldered to a conductor pad 10 on the upper surface 12 of the board and to a conductor pad 14 on the downwardly facing surface 16 of the circuit board. The terminal has a receptacle portion 18 which is adapted to receive a lead 6 of a DIP 8, a transition section 20 which adjoins the receptacle portion, and a mounting portion 22 which extends through the hole 9 in the printed circuit board.

The receptacle portion is generally rectangular in cross section as shown in FIG. 3 and has a spring supporting side 24, a side 26 which is opposite to the spring supporting side, and opposed sides 28, 30 which extend between the sides 24, 26. Side 24 is cut away as shown at 32 from the sides 28, 30 and a hairpin type spring generally indicated at 34 extends from the spring supporting side downwardly towards the transition section 20. The spring 24 is reversely curved as shown at 38 adjacent to the lower end of the receptacle portion so that the spring has an upwardly extending arm 40 which is inclined towards the internal surface of the side 24. The arm 40 is again reversely formed through an angle of about 60° as shown at 42 so that the end or tip portion 44 of the arm extends obliquely upwardly and towards the internal surface of the side 26. A rectangular opening 48 (FIG. 4) is provided in the side 26 adjacent to the upper end thereof and the extreme edge 46 of the spring is received in this opening so that a downwardly inclined surface 50 is provided to guide a lead being inserted into the receptacle. It will be apparent from FIG. 1 that the lead, upon downward movement from the position shown, can not become lodged between the edge 46 and the internal surface of the wall 26 but will be deflected when it engages the surface 50 and guided downwardly into the receptacle.

An opening 52 is provided on the corner between the sides 24 and 30 adjacent to the upper end of the receptacle portion and the portion on the side 24 which is immediately adjacent to, and beside, this opening is inwardly formed as shown at 54 to provide an arcuate contact surface which is opposed to the contact surface defined by bend 42 in the arm 40. When a lead is inserted into the receptacle, the spring arm 30 clamps the lead against the inwardly formed portion 54 of side 24 to establish electrical contact.

As will be explained below, the terminal is formed from the flat blank shown in FIG. 7 in a manner such that the edge 58 (FIG. 3) of the wall 24 abuts the internal surface of the wall 28 adjacent to the vertically extending edge 60 of the latter wall. Edge 60 is directed rightwardly as viewed in FIG. 3 and is exposed on the exterior of the receptacle portion. Advantageously, the internal surfaces of the walls are swaged to provide inclined beveled lead-in surfaces as shown at 62.

The transition section 20 comprises the lower portion of the wall 26 and portions of the sidewalls 28, 30 which are of reduced width in the transition section as best shown in FIG. 1. The sidewalls are formed inwardly and tapered downwardly towards each other as shown at 64 (FIGS. 2 and 6) and at their lower ends they merge with a V-shaped section 66 of the mounting portion 22. This V-shaped section 66 is of substantially uniform cross section for a distance equal to the thickness of the printed circuit board 4. V-shaped section 66 merges with a lower V-shaped section 67 in which the edges 70 of the V taper towards the bight portion 71. The terminal can thus be moved downwardly through the hole in the printed circuit board with its lower end serving as a pilot or guide for the V-shaped section 66. It should be noted that a relatively small but very distinct shoulder 68 is provided between the edges of the portions 64 and 66 and these shoulders serve as positive stops which prevent insertion of the terminal into the circuit board beyond the plane defined by the downwardly facing shoulder surfaces.

It is desirable to provide a coating or plating as indicated at 72 on the terminal surface of the transition portion 20 which is resistant to wetting by solder in order to prevent the solder from flowing up to the spring portion 38 and to induce the solder to flow laterally over the surface of the pad 10 on the surface 12 of the board. This coating may comprise a thin electro plated deposit of chromium or a coating of any other suitable solder resist material.

Terminals in accordance with the invention can be manufactured in any desired size and from a variety of materials. Good results are obtained by using a phosphour bronze having a thickness of 0.010 inches in the manufacture of a terminal device having an overall height of about 0.31 inches and a width of about 0.065 inches in the receptacle portion 18. The mounting portion 22 will, or course, be dimensioned to conform to the hole diameter of the circuit board holes but it should be such that the sidewalls of the portion 66 are progressively flexed inwardly and towards each other as the terminal mounting portion is moved into the hole 9 in the circuit board. This inward flexure of the portion 66 can be observed by comparing FIGS. 5 and 6B. It will be appreciated that flexure of the sidewalls of the V-shaped portion 66 results in the development of a contact pressure in the inserted terminal; that is, the sidewalls of the section 66 bare against the surface of the hole in the circuit board and the apex of the section 66 is also forced against the surface of the hole. As a result of these forces, the terminal is extremely stable and is firmly mounted in the hole prior to soldering so that the circuit board can withstand all of the handling and abuse which it must undergo during the manufacturing process prior to soldering. The resilient forces caused by flexure of the mounting portion 66 are augmented also that by the fact that the lower portion 70 of the post moves into the hole, the soft plating material, usually tin, on the wall will be gouged by the edges 70 of the terminal and accumulated against the edges of the V-shaped section 66. The accumulated solder further contributes to the stability of the terminal in the hole.

FIG. 8 shows a terminal having a modified form of the mounting portion 23 which is particularly intended for insertion by automatic or semi-automatic insertion machine. The mounting portion 23 differs from the mounting portion 22 of the terminal previously described in that the external surface thereof adjacent to the lower end of the mounting portion is inclined inwardly and rightwardly as viewed in FIG. 8 while the edges 71 extend substantially parallel to each other. This configuration is more convenient for machine insertion in that the extreme lower end of the mounting portion is located adjacent to the axis of the mounting portion. When the mounting portion is inserted into a hole in the printed circuit board, it is aligned approximately with the center of the hole. As the terminal is progressively inserted, the tapered external apex moves through the hole 9 until the uniform cross section portion 66 is disposed in the hole. The configuration for the leading or lower end of the mounting portion shown in FIG. 8 is desirable for machine insertion applications for the reason that there is less liklihood, than with the previous embodiment, that the lower end of the terminal will move against the surface of the circuit board rather than into the circuit board hole.

The terminal shown is manufactured in the form of a continuous strip as shown in FIG. 7 by blanking the strip to form a blank 2'. The blank is connected by a connecting neck 78 to a carrier strip 74 which has spaced-apart pilot holes 76 by means of which it is fed through the stamping and forming die and, at the time of use, through the insertion machine which inserts the terminals of a strip into printed circuit boards. The same reference numerals, differentiated by prime marks, are used to identify the parts of the blank of FIG. 7 and the parts of the finished terminal. During forming, the spring 34 is first formed by bending the arm 34' of the blank and the receptacle portion in the mounting and transition portions are thereafter formed in surrounding relationship to the spring.

As previously mentioned, the terminal shown is particularly intended for use with circuit boards having conductors 10, 14 on both surfaces thereof and having holes 9 which are provided with a thin plating of conductive metal, particularly tin. Upon soldering in a wave soldering machine, the solder will flow upwardly under the influence of capillary forces, and under the influence of the dynamic forces in the solder bath which result from the presence of the standing wave of the bath. Quite often, and with many previously known terminal receptacles, these forces are sufficient to cause the solder to flow up to the vicinity of the spring in the receptacle with resulting incapacitation of the spring so that the terminal must be replaced. Terminal receptacles in accordance with the invention resist the upward flow of solder beyond the bend 72 of solder material so that the solder is forced to flow laterally when it reaches a level immediately above the shoulder 68 and cover the surface of the terminal pad 10. Other features of the device prevent the upward flow of solder to the spring; for example, the lower end of the spring, the reverse bend therein 38, is elevated by a substantial distance from the surface of the circuit board.

The disclosed generally V-shaped mounting portion 66 is particularly advantageous for use under circumstances where it is desired to have the solder flow up through the hole in the printed circuit board and solder a circuit pad 10 on the upper surface of the board to the terminal as shown in FIG. 6B. Good manufacturing practice requires that when a conductor pad on the upper surface of the circuit board is to be soldered to an inserted terminal, the solder should extend around the entire surface of the pad and extend continuously from the surface portions of the terminal to the pad. This 360° soldering requirement is not always achieved with many known types of terminals and it is readily achieved with terminals in accordance with the instant invention. Complete 360° soldering is achieved in the practice of the invention because of the fact, as shown in FIG. 6B, that three passageways extend from the upper surface of the board to the lower surface thereof as shown at 82, 84, 86, the passageways 82 and 84 being defined by the outwardly facing sidewalls of the terminal and the opposed surface portions of the plated hole while the passageway 86 is defined by the opposed internal surface of the terminal and the adjacent surface portions of the hole. These three passageways are equally spaced apart around the circumference of the hole so that solder flowing through any one of the passageways and onto the surface of the pad 10 need flow only a relatively short distance until it merges with the front of solder flow eminating from the adjacent passageways.

The reversely formed spring 34 of the disclosed embodiment provides several significant advantages. As is apparent from an inspection of the blank, FIG. 7, the developed length of the blank is quite long so the effective length of the spring is similiarly quite long. The length of the spring 34 and the reverse bend 38 in the spring permit the achievement of a relatively low and constant spring rate rather than a spring which resists reflection at a greatly increasing rate as the amount of deflection is increased. By virtue of this low spring rate of the instant invention, the receptacle will accept DIP leads 6 of widely varying thicknesses and the device can, therefore, be used with a variety of standard types of DIP's. Specifically, a device as described above produced from phosphour bronze having a thickness of about 0.010 inches is capable of accepting leads having the thickness in the range of at least 0.008 inches to 0.015 inches and good contact will be established with leads at the extreme limits of these thicknesses.

Devices in accordance with the invention can be manufactured and dimensioned such that they will have an overall height of about 0.220 inches above the surface 12 of the printed circuit board and a width at the receptacle portion 18 of about 0.065 inches. Terminal devices having these dimensions can be mounted in the printed circuit board on centers which are spaced-apart by 0.10 inches, a widely used standard in the electronics industry.

The provision of the reverse bend 38 in the spring is also advantageous in that the inner end of the enclosure defined by the spring functions as a positive stop for the inserted DIP lead. There is no possibility then that the lead from the DIP may be inserted to the extent that its end will be adjacent to the surface of the board with a resulting possibility of the lead being soldered to the board. Furthermore, the contact area for the inserted lead is adjacent to the upper end of the receptacle portion so that the surface of the lead will be wiped by the contact surfaces of the spring during insertion, a feature which will contribute to the removal of oxides and other impurities on the surface of the lead so that good electrical contact will be obtained. Since the spring 38 is completely enclosed in the receptacle, it is protected against damage during handling, shipment, and during insertion of the terminal into the printed circuit board. The fact that the spring is fully enclosed also gives rise to an anti-overstress feature since the arm 40 can not be moved leftwardly as viewed in FIG. 1 beyond the internal surface of the wall 26. The spring is thus resistant to such damage or destruction which might be caused by the insertion of an oversized lead wire from a component or a foreign object.

Terminal devices in accordance with the invention are resistant to another form of damage which frequently occurs during wave soldering of the inserted terminals to the printed circuit board. Specifically, in many types of receptacle devices, the free end of the spring is normally disposed against a fixed surface in the receptacle portion and during wave soldering, the free end can become bonded to the surface against which it is disposed if the heat of the soldering bath is sufficient to cause reflowing of the tin plating of the devices. Terminals in accordance with the instant invention are resistant to this type of damage for the reason that the contact surface is quite remote from the surface of the printed circuit board and, therefore, heat must flow from the solder bath to the upper or free end of the device and then along the full length of the spring 34 to the bend 42 to heat the bend. This long path permits the dissipation of much of the heat transmitted to the terminal during soldering by radiation and convection so that the contact surfaces, particularly the surface at the bend 42, are never heated to an extremely high temperature such as would cause reflow of the tin plating.

As discussed previously, printed circuit board receptacle terminals are available as free standing terminal receptacles and alternatively as terminals mounted in plastic housings. The use of a plastic housing is desirable for several reasons; the terminals in the housing are protected against damage during handling and insertion and are protected against damage after the housing has been assembled to the circuit board. Furthermore, when the terminals are contained in a housing, the problems of solder flow into the terminal during wave soldering can usually be avoided or minimized by proper design of the housing. However, the use of an insulating housing greatly increases the cost of providing receptacle terminals on a printed circuit board since the individual terminals must be assembled to the housing prior to assembly of the housing to the circuit board and the cost of the housing itself increases the overall applied cost of the terminals on the circuit board. Receptacle terminals in accordance with the instant invention are, as mentioned above, of the free standing type and therefore enjoy the advantage of lower applied cost than terminals mounted in housings. However, terminals in accordance with the invention can provide most, if not all, of the advantages attained when the more costly types of terminals in housings are used. Terminal receptacles in accordance with the invention are extremely rugged, are protected against overstress, and the springs are fully protected by virtue of the fact that they are enclosed. Finally, good soldering characteeristics are realized without the risk of solder flow into the receptacle portions of the terminals. In other words, the advantages attained by the use of a separate housing inure to terminals in accordance with the instant invention which are free standing and therefore lower in cost.

What is claimed is:

1. A stamped and formed receptacle which is intended to receive an electrical lead, said receptacle comprising:

a hollow tubular structure having a rectangular cross section, said structure having a lead-receiving end and an inner end, said structure having been formed from a flat blank having opposite side edges by bending said blank and locating said side edges adjacent to each other at a seam which extends between said ends, a hair pin spring having a fixed end which extends from one wall of said structure intermediate said ends, said spring extending from said fixed end thereof towards said inner end of said structure thence through said structure towards said free end, said spring having a tip portion which is reversely formed and which is proximate to said lead-receiving end, said one wall being inwardly formed towards said tip portion, opposed surface portions of said one wall and said reversely formed tip portion constituting a constructed contact portion for an inserted electrical lead.

2. A receptacle as set forth in claim 1, said receptacle having a transition portion extending from said inner end and having a mounting portion extending from said transition portion, said receptacle being intended for mounting in a hole in a printed circuit board.

3. A receptacle as set forth in claim 1, the wall of said structure which is opposed to said one wall having an opening therein adjacent to said lead receiving end, said reversely formed tip extending obliquely towards said opening and generally toward said lead receiving end.

4. A stamped and formed terminal receptacle comprising:

a box-like structure having an open lead-receiving end and a lower end, said structure having been produced by folding a flat, generally rectangular blank along three parallel fold lines to form three corners of said structure, a forth corner of said structure being formed by the adjacent abutting edges of said blank, said receptacle having a spring support side, said spring support side having an integral spring extending, cantilever fashion, therefrom towards said lower end, said spring having a 180° bend therein and having an intermediate arm which extends from said bend into said structure generally towards said lead-receiving end, and obliquely towards said spring support side, said intermediate arm having a reversely formed contact bend which provides a convex contact surface adjacent to said spring support side, said spring having a free end portion extending from said contact bend obliquely towards the side which is opposite to said spring support side and towards said lead-receiving end, said spring support side having an inwardly formed portion which is opposed to said contact bend to provide a fixed contact surface, and said opposite side having a clearance opening therein intermediate said ends of said structure to permit movement of said free end portion away from said spring support side, said free end portion having transversely extending edges at the tip thereof, said edges being normally disposed in said opening whereby uninterrupted convergent lead-in surfaces which extend towards said contact surfaces are provided for a lead being inserted into said structure from said lead-receiving end.

5. A stamped and formed terminal receptale device which is intended for mounting in a hole in a printed circuit board comprising:

a receptacle portion, a standoff portion, and a mounting portion, said receptacle portion comprising a box-like structure having an open lead-receiving end and a lower end, said structure having been produced by folding a flat, generally rectangular blank along three parallel fold lines to form three corners of said structure, a forth corner of said structure being formed by the adjacent abutting edges of said blank, said standoff portion being integral with, and extending from, one side of said structure and from two opposite sides which adjoin said one side at said lower end of said structure, said mounting portion extending from said standoff portion, said standoff portion having a width, as measured transversely of said opposite sides, which is substantially less than the width of said opposite sides, said mounting portion having a width which is less than the width of said standoff portion whereby a mounting stop shoulder is formed between said standoff and mounting portions for engagement with said printed circuit board, said mounting and standoff portions having marginal side portions which are formed inwardly towards each other and towards the longitudinal axis of said device, said receptacle portion having a spring support side which is opposed to said one side, said spring support side having an integral spring extending, cantilever fashion, therefrom towards said standoff portion, said spring having a 180 degree bend therein and having an intermediate arm which extends from said bend into said structure generally towards said lead-receiving end, and obliquely towards said spring support side, said intermediate arm having a reversely formed contact bend which provides a convex contact surface adjacent to said spring support side, said spring having a free end portion extending from said contact bend obliquely towards said one side and generally towards said lead-receiving end, said spring support side having an inwardly formed portion which is opposed to said contact bend to provide a fixed contact surface, and said one side having a clearance opening therein intermediate said ends of said structure to permit movement of said free end portion away from said spring support side, said free end portion having transversely extending edges at the tip thereof, said edges being normally disposed in said opening whereby uninterrupted convergent lead in surfaces which extend towards said contact surfaces are provided for a lead being inserted into said stucture from said lead receiving end.

* * * * *